US006953772B2

(12) United States Patent
Lopes

(10) Patent No.: US 6,953,772 B2
(45) Date of Patent: Oct. 11, 2005

(54) CONCENTRATED SANITIZING COMPOSITIONS FOR CLEANING FOOD AND FOOD CONTACT SURFACES

(76) Inventor: John A. Lopes, 2209 Niagra Dr., Troy, MI (US) 48083

( * ) Notice: Subject to any disclaimer, the term of this patent is extended or adjusted under 35 U.S.C. 154(b) by 0 days.

(21) Appl. No.: 10/657,902

(22) Filed: Sep. 9, 2003

(65) Prior Publication Data

US 2004/0048755 A1 Mar. 11, 2004

Related U.S. Application Data

(63) Continuation-in-part of application No. 09/908,527, filed on Jul. 18, 2001, now Pat. No. 6,617,290.

(60) Provisional application No. 60/219,256, filed on Jul. 18, 2000.

(51) Int. Cl.[7] ..... C11D 17/00

(52) U.S. Cl. ..... 510/111; 510/218; 510/370; 510/371; 510/382; 510/383; 510/405; 510/407; 510/413; 510/421; 510/422; 510/431; 510/437; 510/424; 510/477; 134/41

(58) Field of Search ..... 510/111, 218, 510/330, 321, 382, 383, 405, 413, 421, 422, 424, 434, 437, 477

(56) References Cited

U.S. PATENT DOCUMENTS

| | | | | | |
|---|---|---|---|---|---|
| 5,143,720 | A | * | 9/1992 | Lopes | 424/55 |
| 5,280,042 | A | * | 1/1994 | Lopes | 514/557 |
| 5,849,678 | A | * | 12/1998 | Murch et al. | 510/111 |
| 5,942,478 | A | * | 8/1999 | Lopes | 510/130 |

* cited by examiner

*Primary Examiner*—Necholus Ogden
(74) *Attorney, Agent, or Firm*—Arnold S. Weintraub

(57) ABSTRACT

The invention teaches the preparation of a concentrated sanitizing and cleaning preparation. The preparation has a dual use for cleaning and sanitizing food surfaces as well as food contact and non-food contact surfaces. The composition of the invention shows rapid microbicidal properties against representative gram positive and gram-negative bacteria. The invention uses GRAS, food additive ingredients and/or ingredients that are approved by the USFDA for use on food.

19 Claims, No Drawings

CONCENTRATED SANITIZING COMPOSITIONS FOR CLEANING FOOD AND FOOD CONTACT SURFACES

CROSS REFERENCE TO RELATED APPLICATIONS

The present application is a continuation-in-part application of U.S. patent application Ser. No. 09/908,527, filed Jul. 18, 2001 now U.S. Pat. No. 6,617,290, which, in turn, is related to U.S. Provisional Application Ser. No. 60/219,256, which was filed on Jul. 18, 2000, the disclosures of which are hereby incorporated by reference.

BACKGROUND OF THE INVENTION

This invention relates to sanitizing chemical compositions that can be used on fresh fruits and vegetables as well as on hard surfaces that come in contact with food thereby reducing the risk of illness caused by harmful chemical residues and/or infectious contaminating microorganisms. The invention further helps to increase the shelf life or keeping qualities of food by reducing the population of spoilage microorganisms carried on the surface of the food.

Most common antimicrobial products accomplish reduction of microbial populations on food and hard food contacting surfaces by oxidation of the target microorganism. To accomplish this, common antimicrobial products of this type contain or utilize compounds having highly oxidizing compounds such as chlorine, chlorine dioxide, peracetic acid, ozone, hydrogen peroxide used to reduce microbial population on food. These oxidizing chemicals inactivate microorganisms by reacting with their organic material. However, these chemicals can also react deleteriously with organic food material and other compounds to produce unknown chemical residues which may be harmful to health. For instance studies have indicated that hypochlorite (chlorine) produces carcinogenic residues on food in certain situations.

An additional drawback of these common antimicrobial oxidative products are compositions which generally lack significant detergent action or cleaning properties. Thus it is often necessary to employ several materials in potentially multi-step cleaning processes to remove all undesirable material and residue from the foodstuff or hard food contacting surface.

Most chemical products suitable for use on foodstuff or hard food contact surfaces do not have significant antimicrobial and microbial properties. Sanitizing products which exhibit significant antimicrobial and/or microbicidal properties have historically been considered unsafe or suspect as containing ingredients which are not classified by the United States Food and Drug Administration (USFDA) as GRAS (Generally Regarded As Safe) for food contact or as a food additive.

Various other sanitizing products require incorporation of additional antibacterial compounds in the preparation to inhibit or kill microorganisms. Such commercial sanitizing products are permitted for use on food contact hard surfaces. However, they cannot be used on fruits and vegetables as they have certain components that are expressly prohibited for use on fresh foods by regulatory agencies.

Additionally, it is economically or logistically necessary to store and ship such sanitizing preparations as concentrate liquids or solids which can be dissolved or diluted to a suitable use solution. Various known formulations can exhibit cloudiness, opalescence or precipitate when diluted with tap water. This phenomenon can interfere with the optimal function of the sanitizing solution.

Thus it would be highly desirable to provide a sanitizing composition which was composed entirely of components approved by regulatory agencies such as the US FDA for use on both fresh fruits and vegetables. It is also desirable that the aforementioned solution be capable of achieving cleaning and sanitizing of food contacting hard surfaces thereby providing a composition which can be utilized for various cleaning and sanitizing operations with increased efficiency and economy. It is also desirable to provide a cleaning and sanitizing composition which can be prepared and stored in a highly concentrated form increasing ease in storage and transport. It is also desirable that the sanitizing material be suitable for use in automatic dispensing operations thereby eliminating risks involved in manual handling. It is also desirable that the composition be one which results in a clear solution without opalescence, cloudiness or precipitate particularly when a concentrated form of the composition is diluted with water.

SUMMARY OF THE INVENTION

In accordance herewith, there is provided a class of chemical compositions or agents that can be used to prepare antimicrobial detergent compositions for cleaning surfaces of food products such as fresh fruits, vegetables, seeds, sprouts, eggs, carcasses and other food surfaces in order to prevent, to reduce or to eliminate the risk of infection and illness arising from microbial contamination and harmful chemical residues. The compositions can also be employed to reduce spoilage microorganisms present on the surface of such food products thereby increasing keeping qualities of food. The compositions can also be used to clean and disinfect inanimate food contact and non-food contact surfaces.

The antimicrobial cleaning composition contains:

a. an acidifying agent which is present either as an individual acid or as a mixture of acids, at least citric acid, phosphoric acid or a mixture thereof, these acidifying acids being classified as GRAS or suitable for use as food additive by the US FDA;

b. at least one agent selected from chemicals approved by the US FDA and the USDA for use on food products as well as for use on food-contacting hard surfaces; and c. at least one cleaning agent selected from chemicals classified as GRAS or suitable for use as food additive by the US FDA.

The composition of the present invention may also include at least one carrying agent compatible with the aforementioned compounds. The carrying agent typically functions as a suitable diluent and is present in liquid, powder or gel form to dissolve or disperse or suspend the above aforementioned ingredients.

The composition may include other compatible ingredients, which do not reduce or interfere with the antimicrobial and cleaning properties. Certain ingredients such as organic and inorganic salts, urea, which may enhance the cleaning properties, may also be incorporated. The composition may additionally include compounds from among coloring agents, antioxidants, fragrances, vitamins, nutritive agents and thixotropic agents as well as any combination of the above.

DETAILED DESCRIPTION OF THE PREFERRED EMBODIMENT

The cleaning and sanitizing composition of the present invention may be employed in either a concentrated composition or in a ready-to-use formulation. The cleaning and sanitizing composition contains:

a. an acidifying agent, which is at least either lactic acid, phosphoric acid or a mixture thereof;
b. at least one agent;
c. at least one sequestering or chelating agent; and
d. a carrier compatible with the acidifying agent, agent and chelating agent, the carrier present in sufficient quantity to contain the acidifying agent, agent and chelating agent.

The acidifying agent, agent, chelating agent, and carrier are each selected from chemical compounds which are classified as GRAS or suitable for use as food additive by the US FDA or, at minimum, approved for use on food-contacting surfaces.

The acidifying agent is at least one compound selected from lactic acid, phosphoric acid or both. Other useful acids which may be in admixture with the lactic and/or phosphoric acid include adipic acid, benzoic acid, malic acid, sorbic acid, succinic acid, tannic acid, tartaric acid, sulfuric acid, phosphoric acid, nitric acid, hydrochloric acid, sulfamic acid, carboxylic acid polymers, homo- or hetero-polymerized alph hydroxycarboxylic acid such as polyactic acid or poly lactic-glycolic acid and mixtures of two or more of said acids.

Preferably, the acidifying agent is at least one compound from the group which includes acetic, adipic, ascorbic, citric, dehydroacetic, erythrobic, fumaric, glutaric, gluconic, hyaluronic, glycolic, lactic, malic, succinic, sulfamic, tannic, tartaric as well as mixtures of two or more of these acids.

While the acidifying agent can be a single compound of lactic or phosphoric acid, it is preferable that the acidifying agent be a combination of the aforementioned acids present in ratios and concentrations which is sufficient to provide a pH in the resulting use solution below 5. Typically, two or more acids will be employed in combination with another. In a first embodiment, the preferred combinations are those which include at least one acid from the group including lactic, phosphoric and citric acid together with other above-listed acids. In such instances it is preferred that the acidifying agent constitute 40% to 60% of the concentrate composition. It is generally preferred that between 25% and 40% of the acidifying component of the composition be lactic acid. When used as a single acidifying agent, then concentration of lactic acid (88%) can be up to 95% of the concentrate composition with between 40% and 95% being preferred. In the most preferred embodiment, the acidifying agent used in the composition includes lactic acid, phosphoric acid, and citric acid. The ratio of lactic acid (88%) phosphoric acid (75%), citric acid (100%) preferably is 40:10:10, 35:12:6, 32:13:5, 32:13:3 and 25:10:5. It has been found that a combination of lactic and phosphoric acids, in various ratios, along or in admixture with the other acids enumerated above is also effective herein. The most preferred ratio is 25:10:5 and 32:13:5. It has been found that a combination of lactic and phosphoric acids, alone, and various ratios, or in admixture with the other acids enumerated above is also effective herein.

Both these acids, i.e., lactic and phosphoric, can be used to lower the pH. Lactic acid, additionally, imparts solubilizing properties for incorporating higher concentrations of anionic agents to prepare concentrated sanitizing compositions. Thus, weight ratios of phosphoric to lactic acid varying from 0% to 40% of phosphoric acid with 0% to 60% lactic acid are used to prepare concentrated sanitizers using anionic agents. Phosphoric acid is a stronger acid and can be used at lower concentration than lactic acid to lower the pH, which offers economic advantage to the formulation. Lactic acid on the other hand solubilizes higher concentrations of anionic agents. Lactic acid is used in sanitizing compositions where anionic surface-active agents are hydrolyzed by phosphoric acid.

Agents can be selected from active and/or emulsifying agents classified by the US FDA as generally regarded as safe (GRAS) and/or classified as food additive, and/or allowed for use on food products and food contact surfaces as those terms are defined by the United States Food and Drug Administration in the Code of Federal Regulations, Chapter 21, Parts 178, 184, and 186 or which have low toxicity and have been approved for specific uses by applicable regulatory agencies. These surfactants and/or emulsifying agents include free acid forms or salt forms (e.g. the ammonium, sodium potassium, calcium and magnesium salts) of anionic surfactants having at least one hydrophobic group. The hydrophobic group contemplated herein consists of substituted or unsubstituted -alkyl, n-alkenyl, -alkylbenzyl, or alkyl (monomethyl and dimethyl) naphthalene groups with the length of alkyl/alkenyl chains equivalent to 6 to 16 carbon atoms. The agent also includes at least one hydrophilic group from the group containing monocarboxylic acid, dicarboxylic acid, sulfate, sulfonate, phosphate and phosphonate groups as well as combinations of these groups.

The concentration of the agent (surfactant) in the sanitizing composition of the present invention is broadly defined as that sufficient to maintain the various components thereof in suitable solution. The surfactant is generally present in an amount between 0.0001% to 50% by composition weight. The most preferred concentration of the surface-active agent is between 4.0% and 6.4% by weight.

The anionic and/or emulsifying agents may be used in concentrations ranging from about 10 ppm to about up to 200,000 ppm. The anionic surfactant can be used as a single molecular species or in combination with other anionic and/or noninonic/cationic/amphoteric molecular species.

Surfactant/emulsifying materials which are contemplated for use herein include:

a. $C_6$–$C_{16}$ alkyl- and alkenyl sulfonates;
b. $C_6$–$C_{16}$ alkyl- and alkenyl ether sulfates;
c. $C_6$–$C_{16}$ alkyl diphenyl ether disulfonates;
d. dialkyl- and dialkenyl sulfosuccinates in which the alkyl or alkenyl groups independently contain from six to sixteen carbon atoms;
e. alkyl benzene sulfonates in which the alkyl group contains from six to sixteen carbon atoms;
f. napthalenesulfonates;
g. alkylnapthalenesulfonates in which the alkyl group contains from one to six carbon atoms;
h. the mono-(n-alkyl) and mono (n-alkenyl) acyl esters of $C_2$–$C_4$ hydroxylated monocarboxylic acids, in which the alkyl or alkenyl group contains from six to sixteen carbon atoms;
i. the mono-(n-alkyl) and mono (n-alkenyl) acyl esters of $C_2$–$C_4$ hydroxylated dicarboxylic acids, in which the alkyl or alkenyl group contains from six to sixteen carbon atoms;
j. the mono-(n-alkyl) and mono (n-alkenyl) alkyl esters of $C_2$–$C_4$ dicarboxylic acids, in which the alkyl or alkenyl gropu contains from six to sixteen carbon atoms; and
k. $C_4$–$C_{16}$ fatty alcohol sulfoacetates.

By the term "alkyl" as used throughout this specification and the appended claims is meant a monovalent straight or branched chain hydrocarbon radical which can be thought of as derived from a saturated acyclic hydrocarbon by removal of one hydrogen atom. By the term "alkenyl" is meant a monovalent hydrocarbon radical containing one or more carbon-carbon double bonds, which radical can be thought of as being derived from an unsaturated acyclic hydrocarbon by the removal of one hydrogen atom.

The term "salt of a mono (n-alkyl) and mono (n-alkenyl) acyl esters of $C_2$–$C_4$ hydroxylated monocarboxylic acid" means an ester salt of hydroxylated monocarboxylic acid, such as lactic acid, which has been formed by esterification of its hydroxyl function by another acid, and in which its carboxyl function has been converted to a carboxylate salt. An example of such a compound is so-called "decyl lactylate" which is the ester formed by esterifying the hydroxyl group of lactic acid with decanoic acid, and converting the carboxyl function of the lactic acid portion of the resulting ester to the carboxylate salt form.

Similarly, the term "salt of a mono (n-alkyl) and mono (n-alkenyl) acyl esters of $C_2$–$C_4$ hydroxylated dicarboxylic acid" means an ester salt of hydroxylated discarboxylic acid, such as hydroxymalonic acid, which has been formed by esterification of its hydroxyl function by another acid, and in which its two carboxyl functions have been converted to a carboxylate salts.

By the term "salt of a mono (n-alkyl) and mono (n-alkenyl) acyl esters of $C_2$–$C_4$ hydroxylated dicarboxylic acid" is meant an ester salt of dicarboxylic acid, such as succinic acid, which has been formed by esterification by an alcohol at one hydroxyl group.

Preferred anionic agents for the composition of the present invention include free acids or ammonium, sodium, calcium, potassium, or magnesium salts of 1) alpha olefin ($C_{14}$–$C_{16}$) sulfonic acid; 2) $C_4$–$C_{16}$ fatty acid isethionic acid; 3) $C_4C_{16}$ fatty alcohol sulfoacetic acid; 4) decyl lactylic acid; 5) lauryl sulfuric acid; and 6) 1,4-dihexyl sulfosuccinic acid.

The surface-active agent is preferably selected from alkali salts of ($C_6$–$C_{16}$) n-alkylbenzene sulfonic acids, ($C_6$–$C_{16}$) n-alkylbenzene sulfonic acids and ($C_6$–$C_{16}$) n-alkenyl sulfonic acids. The surface-active agent may include any one of the aforementioned compounds either alone or in combination. The most preferred surface-active agents are sodium dodecylbenzene sulfonate, sodium diioctyl sulfosuccinate, sodium decyl lactylate, sodium alpha olefin sulfonate, as well as mixtures thereof. The concentration of the surface-active agent is selected from 0.001% to 50%. The most preferred concentration of the surface-active agent is between 4% and 6.4% of the concentrate on a weight basis.

These preferred anionic agents include sodium dodecyl sulfate, sodium dioctyl suslfosuccinate, sodium decyl lactylate, sodium dodecyl benzene sulfonate, and sodium alpha olefin sulfonate are either regarded as secondary food additives as per Code of Federal Regulations (CFR 21) or are exempted from tolerance requirement under (CFR 40:180:0001) when present in chemical products used in or on all raw agricultural commodities after harvest cause no hazard to public health.

The sanitizing and antimicrobial composition of the present invention also contains at least one sequestering or chelating agent. As used herein the terms "sequestering" and "chelating" are used interchangeably to mean a compound which, among other functions, will act to reduce cloudiness or turbidity which might otherwise result when the compositions are dissolved or admixed in hard water. Components which may be employed for these purposes include organic compounds such as citric acid, ethylene diamine tetraacetic acid (EDTA), as well as organic salts thereof such as calcium citrate, calcium diacetate, isopropyl citrate, monoisopropyl citrate, potassium citrate, sodium citrate, stearyl citrate, and sodium gluconate. Components may also include inorganic compounds sodium acid phosphate, calcium hexametaphosphate, sodium phosphate, sodium pyrophosphate, tetrasodium pyrophosphate, sodium tripolyphosphate. Materials suitable for use in the composition of the present invention are those chemicals classified as GRAS or as suitable for food additives by the US FDA.

The sequestering agent, preferably, is selected from at least one of the following: citric acid, sodium acid pyrophosphate and EDTA with the most preferred sequestering agent being sodium acid pyrophosphate. The concentration of sequestering agent in the concentrate is contemplated between 2% and 10% by weight with the most preferred concentration being between 4% and 6% by weight.

Suitable carriers or solubilizers are selcted from water and/or various alcohols such as ethyl and propyl alcohols or glycols or a mixture thereof. Water, ethyl alcohol, and propylene glycol are preferred solubilizing agents with water being the most preferred solubilizer. The concentration of water is selected from 10% to 80% w/w. The most preferred concentration is between 50% to 70%.

The composition may additionally include emulsifying or surface-active agents such as lecithin, polysorbate 60, polysorbate 65, polysorbate 80, sucrose fatty acid esters, salts of stearoyl 2-lactylate and other agents classified as food additive or GRAS by the US FDA.

As indicated previously, the present invention contemplates the production of a sanitizing composition, which can be used on both food as well as food contact surfaces to clean and sanitize the target surface. Where these acids are used, the acidifying agents preferably used in the composition include lactic acid, phosphoric acid, and citric acid. The ratio of lactic acid (88%); phosphoric acid (75%); citric acid (100%) preferably is between 40:10:10 and 25:13:5 with ratios such as 40:10:10, 35:12:6, 32:13:5, 25:10:5 and 32:13:5.

The surface-active agent is preferably selected from alkali salts of ($C_6$–$C_{16}$) n-alkylbenzene, ($C_6$–$C_{16}$) n-alkyl and ($C_6$–$C_{16}$) n-alkenyl sulfonic acids. The most preferred surface-active agent is sodium dodecylbenzene sulfonate. The concentration of the surface-active agent is selected from 0.001% to 50%. The most preferred concentration of the surface-active agent is between 4% and 6.4% on a weight basis. The sequestering agent is selected from citric acid, sodium acid pyrophosphate and EDTA. The most preferred sequestering agent is sodium acid pyrophosphate. The concentration of sequestering agent is selected from 2% to 10%. The most preferred concentration is 5% w/w. Water and propylene glycol are preferred solubilizing agents. Water is the most preferred solubilizer. The concentration of water is selected from 20% to 80% w/w. The most preferred concentration is between 50% to 70% w/w.

The composition is prepared by first mixing liquid ingredients such as lactic acid, phosphoric acid and water. The solid ingredients, namely citric acid, sodium acid pyrophosphate and sodium dodecylbenzene sulfonate, are then dissolved in the solution to make the final composition.

The sanitizer composition hereof also may have lubricating properties by enabling reduction of frictional properties between two surfaces. Incorporating natural gums, synthetic polymers, certain esters, or other ingredients with high molecular weights that impart rheological properties to the sanitizer composition, can further enhance its lubricating properties. Optional compounds bearing negative and/or positive charges, which reduce friction by adsorbing onto the surfaces, can also be incorporated in a sanitizing lubriocating composition. Thus the sanitizer composition can also be used as sanitizing lubricant in food and beverage processing plants.

Additionally incorporating foaming and defoaming agents, the foaming properties of the sanitizer composition can be modulated depending on the application.

A concentrated sanitizing composition prepared with certain anionic agents such as sodium alpha olefin sulfonate does not require chelating agents to counteract haziness or precipitate produced by water hardness when preparing use solution with hard water. Thus the sanitizer preparation is rendered more economical.

The embodiment of the invention is illustrated by following examples, which are illustrative and not to be construed as limitative of the scope of the present invention.

For a more complete understanding of the present invention reference is made to the following illustrative, non-limitative examples. In the examples all parts are by weight absent contrary indications.

EXAMPLE 1

The composition according to the disclosure of the present invention was prepared as outlined above using the compounds and concentrations set forth in Table 1.

TABLE 1

COMPOSITION FOR CLEANING FOOD SURFACES

| Ingredient | W/V |
|---|---|
| Lactic acid 88% | 25.0 |
| Phosphoric acid | 10.0 |
| Citric acid (powder) | 5.0 |
| Sodium acid pyrophosphate | 4.0 |
| Sodium dodecylbenzene sulfonate | 4.0 |
| Water | To 100 ml |

The pH of the composition in Example 1 was 2.3 when the composition was diluted 1:100 with municipal tap water to form a use solution. The concentration of sodium dodecylbenzene sulfonate is 400 ppm in the dilute solution. The preparation was tested for stability at 4° C. and did not show any precipitate or turbidity after 30 days at 4° C.

The sanitizing and disinfecting efficacy of the dilute aqueous solution of Example 1 was evaluated using the procedure of Method No. 6 from the 13$^{th}$ Edition of the *Official Methods of Analysis of the A.O.A.C.,* 1111 North 19$^{th}$ Street, Alexandria, Va. 22209. The composition in Example 1 was tested for bactericidal properties essentially by the modified A.O.A.C. (Association of Analytical Chemists) germicidal and detergent sanitizer test using *Staphylococcus aureus* ATCC 6538 and *Escherichia coli* ATCC 11229 (Lopes 1986, J. of Dairy Sci. 69:2791–2796).

One milliliter of the bacterial suspension was added to 99 ml of the test solution containing 1 ml of the composition in Example 1 and 500 ppm of synthetic water hardness. After contact time of 30 seconds and 60, 1 milliliter of the test mixture was rapidly mixed with neutralizing solution to stop microbicidal activity of the test solution. One milliliter and 0.1 milliliter of the neutralized mixture were plated by the pour plate method using brain heart infusion agar for bacterial count. Control consisted of sterile water (with 500 ppm of synthetic water hardness) instead of the test solution. The results are presented in the following tables.

The control was subjected to serial ten fold dilutions to obtain a readable number of bacterial count in the challenge. Table 2 shows the bactericidal properties of the compositions after 30 seconds and 60 seconds contact time against both *Staphylococcus aureus* and *E. coli* the representative bacteria for gram positive and negative group respectively.

The results in Table 2 demonstrate that the composition in Example 1 has microbicidal properties against both gram negative and gram positive test bacteria.

TABLE 2

MICROBICIDAL PROPERTIES AGAINST *STAPHYLOCCUS AUREUS* OF COMPOSITION IN EXAMPLE 1

| | Bacterial Type | | | |
|---|---|---|---|---|
| | *Staphylococcus aureus* | | *Escherichia coli* | |
| | Number of surviving bacteria after contact (cfu/ml) | | | |
| Contact time | 30 seconds | 60 seconds | 30 seconds | 60 seconds |
| Vol. of neutralized test mixture plated | 1.0 ml | 1.0 ml | 1.0 ml | 1.0 ml |
| | 0, 0 | 0, 0 | 0, 0 | 0, 0 |
| Dilution) | Challenge No of bacteria (cfu/ml) | | Challenge No of bacteria (cfu/ml) | |
| $10^{-6}$ | T, T | | T, T | |
| $10^{-7}$ | 216, 259 | | 280, 365 | |
| $10^{-8}$ | 18, 0 | | 19, 26 | |

(*T = Too numerous to count. CFU = colony forming unit)

EXAMPLE 2

The composition according to the disclosure of the present invention was prepared as outlined previously using the compounds and concentrations outlined in Table 3.

TABLE 3

COMPOSITION FOR CLEANING FOOD SURFACES

| Ingredient | Amount, pbw |
|---|---|
| Lactic acid 88% | 32.0 |
| Phosphoric acid 75% | 13.0 |
| Citric acid (powder) | 6.4 |
| Sodium acid pyrophosphate | 5.0 |
| Sodium dodecylbenzene sulfonate | 5.0 |
| Water | 57.0 |

The pH of the composition in Example 2 was 2.3 when diluted in the ratio of 0.78:100 v/v with municipal tap water. The concentration of sodium dedecylbenzene sulfonate is 400 ppm in the dilute solution.

The preparation was tested for stability at 4 degrees C. and did not show any precipitate or turbidity after 30 days at 4 degrees C.

EXAMPLE 3

A series of sanitizer compositions were prepared from varying ratios of lactic acid and phosphoric acid. The following table, Table 4, sets forth the ingredients and amounts.

| Ingredients | Composition, amount, pbw A | B | C |
|---|---|---|---|
| Sodium alpha olefin sulfonate (80%) | 15.00 | 40.00 | — |
| Lactic acid (88%) | 40.00 | 40.00 | 27.03 |
| Phosphoric acid (75%) | 10.00 | 15.00 | 10.98 |
| Lauryl lactylate | 10.00 | 5.00 | — |
| Pluronic F88 Prill (BASF)[1] | 10.00 | — | — |
| Benzoic acid | 5.00 | 5.00 | — |
| Sodium acid pyrophosphate | — | — | 4.22 |
| Sodium alkyl benzene sulfonate | — | — | 4.22 |
| Water | 25.00 | 10.00 | 53.55 |

Compositions A and B did not produce haziness when diluted with hard water and do not require chelating agents to counteract haziness or precipitate produced by hard water when a use solution is prepared with hard water.

[1]A nonionic surfactant sold by BASf under the name PLURONIC F-88, Prills is used to increase the foam.

EXAMPLE 4

This example illustrates the preparation of an oral rinse, which can be diluted with water just prior to use.

| Ingredient | Amount, pbw |
|---|---|
| Lactic Acid (88%) | 16.87 |
| Xylitol | 5.00 |
| Polaxomer 407[1] | 5.00 |
| Mint Flavoring | 5.00 |
| Sodium Decyl Sulfate | 5.00 |
| Menthol | 2.0 |
| Benzoic Acid | 0.50 |
| Artificial Sweetener | 2.00 |
| FD&C Yellow #5 | 0.03 |
| FD&C Blue #1 | 0.03 |
| Water | 53.55 |

[1]A nonionic surfactant sold by BASF under the name PLURONIC P-127.

EXAMPLE 5

This example illustrates the preparation of a lubricant containing food grade or generally regarded as safe components.

At room temperature and with stirring there is prepared a 100 ml volume of liquid lubricant by mixing together in a suitable vessel the following ingredients:

| Ingredient | Amount, pbw |
|---|---|
| Sodium Alpha Olefin Sulfonate 40% | 60.00 |
| Phosphoric Acid 75% | 40.00 |
| Benzoic Acid (Powder) | 4.00 |
| Water | 33.00 |
| Total | 137.00 |

In concentrated form the composition of invention can be used for continuous dilution with water with automatic dispensing systems. The cleaning solution can be reconstituted with water just prior to use from its concentrated form. The composition of invention can be used for cleaning both food and non-food inanimate surfaces.

In conclusion, the composition embodied in the invention is useful for washing food surfaces of chemicals and of bacterial population, and thus rendering food including fresh fruits and vegetables safer for consumption. Dual use of the invention and both food and non-food surfaces reduces inventory of chemical cleaners and sanitizers and saves money in transportation and storage. Automatic metering of the concentrated liquid form enables to avoid the risks of manual handling.

Having, thus, described the invention, what is claimed is:

1. A method for cleaning and sanitizing food and food-contacting surfaces, comprising:

contacting the food or food-contacting surface with a cleaning and sanitizing composition having microbicidal properties, the composition comprising:

(a) a mixture of at least two or more acidifying agents, the at least two acidifying agents being a mixture of lactic acid and phosphoric acid;

(b) at least one anionic surface active agent;

(c) at least one sequestering agent, and wherein the ingredients are generally regarded as safe and/or allowed by the U.S. FDA for use on food, the composition being at a pH of 5.0 or below.

2. The method of claim 1 wherein the composition further comprises at least one solubilizing agent.

3. The method of claim 1 wherein the acidifying agent further includes at least one compound selected from the group consisting of acetic acid, adipic acid, ascorbic acid, benzoic acid, citric acid, dehydroacetic acid, erythorbic acid, fumaric acid, glutaric acid, gluconic acid, hyaluronic acid, hydroxyacetic acid, malic acid, sorbic acid, succinio acid, tannic acid, tartaric acid, sulfuric acid, nitric acid, hydrochloric acid, sulfamic acid, carboxylic acid polymers, homo- or hetero-polymerized carboxylic acid such as poly lactic acid or poly lactic-glycolic acid; or mixtures thereof.

4. The method of claim 1 wherein the ratio of lactic acid to phosphoric acid are present in respective gram percentages varies between 60:0 to 0.40.

5. The method of claim 4 wherein the anionic surface active agent is at least one compound selected from the group including salt or acid forms of anionic surfactants with at least one hydxophobic group and at least one hydrophilic group.

6. The method of claim 5 wherein the at least one hydrophobic group of the surfactant is at last one of substituted or unsubstituted n-alkyl, n-alkenyl, n-alkylbenzyl, or monomethyl and/or dimethyl naphthalene group with the length of the alkyl chain equivalent to 6 to 16 carbon atoms.

7. The method of claim 5 wherein the at least one hydrophilic group has at least one constituent selected from monocarboxylic, dicarboxylic, sulfate, sulfonate, phosphate and phosphonate groups.

8. The method of claim 5 wherein the anionic surface active agent includes at least one of sodium dodecylbenzene sulfonate, sodium alpha olefin sulfonate, sodium dioctyl sulfosuccinate, sodium decyl lactylate and mixtures thereof.

9. The method of claim 1 wherein the surface-active agent is present in an amount between 0.001% to 50% w/w.

10. The method of claim 1 wherein the sequestering agent is at least one of citric acid, EDTA, sodium acid phosphate, calcium citrate, calcium diacetate, calcium hxametaphosphate, monobasic calcium phosphate, disodium phosphate, isopropyl citrate, monoisopropyl citrate, potassium citrate, sodium citrate, sodium gluconate, sodium hexametaphspoate, sodium phosphate, sodium pyrophosphate, tetrasodium, pyrophosphate, sodium tripolyphosphate, stearyl citrate.

11. The method of claim 1 wherein the sequestering agent is sodium acid pyrophosphate present in an amount between 2% and 10% w/w.

12. The method of claim 1 wherein the solubilizing agent is at least one of water, ethyl alcohol and propylene glycol.

13. A method for cleaning and sanitizing food and food-contacting surfaces, comprising:

contacting the food or food-contacting surfaces with an acidifying mixture of agents, each agent or the mixture being:

(a) an acidifying agent of at least a mixture of lactic and phosphoric acid, the mixture being generally regarded as safe and/or allowed by the US FDA for use on food;

(b) at least one anionic surface active agent, present in an amount between 0.001% to 50% w/w, the agent being a compound generally regarded as safe and/or are allowed by the US FDA for use on food;

(c) at least one sequestering agent, the sequestering agent being a compound generally regarded as safe and/or allowed by the US FDA for use on food; and (d) at least one solubilizing agent, the solubilizing agent being a compound generally regarded as safe and/or are allowed by the US FDA for use on food.

14. The method of claim 13 wherein the acidifying agent includes at least one other compound selected from the group consisting of acetic acid, adipic acid, ascorbic acid, benzoic acid, citric acid, dehydroacetic acid, erythorbic acid, fumaric acid, glutaric acid, gluconic acid, hyaluronic acid, hydroxyacetic acid, malic acid, sorbic acid, succinic acid, tannic acid, tartaric acid, sulfuric acid, nitric acid, hydrochloric acid, sulfamic acid, carboxylic acid and polymers, homo- or hetero-polymerized carboxylic acid such as poly lactic acid or poly lactic-glycolic acid; and mixtures thereof.

15. The method of claim 14 wherein the ratio of lactic acid to phosphoric acid in respective gram percentages varies between 60:0 to 0:40.

16. The method of claim 15 wherein the anionic surface active agent is at least one compound selected from the group including salt or acid forms of anionic surfactants with at least one hydrophobic group and at least one hydrophobic group, the at least one hydrophobic group of the surfactants is at least one of substituted or unsubstituted -alkyl, n-alkenyl, n-alkylbenzyl, or monomethyl and/or dimethyl naphthylene group with the length of the alkyl chain equivalent to 6 to 16 carbon atoms, the at least one hydrophilic group has at least one constituent selected from monocarboxylic, dicarboxylic, sulfate, -sulfonate, phosphate and phosphonate group.

17. The method of claim 16 wherein the anionic surface active agent includes at least one of sodium dodecylbenzene sulfonate, sodium alpha olefin sulfonate sodium 2-ethyl hexyl sulfate, sodium lauryl sulfate and mixtures thereof.

18. The method of claim 15 wherein the sequestering agent is at least one of citric acid, EDTA sodium acid phosphate, calcium citrate, calcium diacetate, calcium hexametaphosphate, monobasic calcium phosphate, disodium phosphate, isopropyl citrate, monoisopropyl citrate, potassium citrate, sodium citrate, sodium gluconate, sodium hexametaphosphate, sodium phosphate, sodium pyrophosphate, tetrasodium pyrophosphate, sodium tripolyphosphate, stearyl citrate.

19. A method for lubricating surfaces in food manufacturing and processing industries, comprising:

applying to the surfaces a composition comprising:

(a) a mixture of at least two or more acidifying agents, the at least two acidifying agents being a mixture of lactic acid and phosphoric acids;

(b) a least one anionic surface active agent;

(c) at least one sequestering agent, and wherein the ingredients are generally regarded as safe and/or allowed by the USFDA for use on food, the composition being at a pH of 5.0 or below.

* * * * *